US009688495B2

(12) United States Patent
Hirahara

(10) Patent No.: US 9,688,495 B2
(45) Date of Patent: Jun. 27, 2017

(54) IMAGE FORMING APPARATUS

(71) Applicant: KYOCERA Document Solutions Inc., Osaka (JP)

(72) Inventor: Kazuhisa Hirahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/160,630

(22) Filed: May 20, 2016

(65) Prior Publication Data

US 2016/0347565 A1 Dec. 1, 2016

(30) Foreign Application Priority Data

May 25, 2015 (JP) ..... 2015-105891

(51) Int. Cl.

| | |
|---|---|
| ***B65H 9/14*** | (2006.01) |
| ***B65H 5/26*** | (2006.01) |
| ***B65H 9/00*** | (2006.01) |
| ***B65H 29/52*** | (2006.01) |
| ***B65H 85/00*** | (2006.01) |
| *B65H 29/66* | (2006.01) |

(52) U.S. Cl.

CPC ..... *B65H 9/14* (2013.01); *B65H 5/26* (2013.01); *B65H 9/006* (2013.01); *B65H 29/52* (2013.01); *B65H 85/00* (2013.01); *B65H 29/6681* (2013.01); *B65H 2301/5122* (2013.01); *B65H 2301/512125* (2013.01); *B65H 2404/6942* (2013.01); *B65H 2404/7431* (2013.01); *B65H 2601/272* (2013.01); *B65H 2801/06* (2013.01); *B65H 2801/12* (2013.01)

(58) Field of Classification Search

CPC .... B65H 9/14; B65H 5/26; B65H 2404/6942; B65H 9/006; B65H 2301/3123; B65H 2301/3124; B65H 2404/7431; B65H 2301/512125; B65H 2301/5122; B65H 29/6681; B65H 29/52

See application file for complete search history.

(56) References Cited

U.S. PATENT DOCUMENTS 8,505,913 B2 * 8/2013 Nishii ..... B65H 3/44 271/264
8,590,885 B2 * 11/2013 Seki ..... B65H 3/44 271/10.09

(Continued)

FOREIGN PATENT DOCUMENTS

JP H06-191686 A 7/1994

*Primary Examiner* — Jeremy R Severson

(74) *Attorney, Agent, or Firm* — Studebaker & Brackett PC

(57) ABSTRACT

An image forming apparatus includes a conveying guide and a sheet member. The conveying guide is provided in a joining section and guides a sheet to a conveying roller pair along a main conveying path. The sheet member is provided in the joining section and configured to form a lower conveying path with the conveying guide and to guide the sheet from an upper conveying path toward the main conveying path. The conveying guide has a convex guide part and planer guide parts. The convex guide is provided at a center portion and projects toward the sheet member. The planer guide parts are provided on both sides of the convex guide part. A first gap formed between the convex guide part and the sheet member is narrower than a second gap formed between the planer guide part and the sheet member.

10 Claims, 4 Drawing Sheets

(56) References Cited

U.S. PATENT DOCUMENTS

| | | | | |
|---|---|---|---|---|
| 8,955,839 | B2 * | 2/2015 | Oyama | B65H 5/26 271/226 |
| 9,290,345 | B2 * | 3/2016 | Doyo | B65H 5/062 |
| 9,448,523 | B2 * | 9/2016 | Beck | G03G 15/6567 |
| 2009/0185846 | A1 * | 7/2009 | Okamoto | B65H 5/26 399/388 |
| 2016/0107856 | A1 * | 4/2016 | Tatsumi | B65H 3/66 271/3.2 |

* cited by examiner

IMAGE FORMING APPARATUS

INCORPORATION BY REFERENCE

This application is based on and claims the benefit of priority from Japanese Patent application No. 2015-105891 filed on May 25, 2015, the entire contents of which are incorporated herein by reference.

BACKGROUND

The present disclosure relates to an image forming apparatus configured to form an image on a sheet conveyed along a conveying path by a conveying roller pair.

In image forming apparatus such as a printer and a color printer, a toner image is transferred on a sheet from an image carrier at a transfer nip formed between the image carrier and a transfer roller. On a sheet conveying path toward the transfer nip, a resist roller pair which adjusts a sheet conveying timing is installed. By stopping the rotation of the resist roller pair, a nip is formed between the resist rollers and a front edge of the sheet is abutted against the nip. Then, the sheet deflects in such a way that the front edge of the sheet is aligned along the nip. This collect a skew of the sheet. After that, the resist roller pair is rotated to convey the sheet by synchronizing with the toner image transfer timing at the transfer nip.

The sheet is fed from a sheet feeding cartridge or a manual sheet feeding unit. In recent years, with a diversification of type of the sheet, a plurality of sheet feeding cartridges for each type of the sheets are often prepared. The sheet feeding cartridges are arrayed vertically in general. In a case when a thin sheet is stored in a lower sheet feeding cartridge, there is a problem that wrinkles caused by waving of the sheet is occurred at the skew collecting by the registration roller pair because the thin sheet is not stiff.

Then, in order to prevent the occurrence of such wrinkles, there is an image forming apparatus provided with a guide plate on an upstream side from the resist roller pair in a sheet conveying direction. In the image forming apparatus, when a front edge of a sheet abuts against the guide plate, the guide plate turns corresponding to stiffness of the sheet and deflects the sheet corresponding to a thickness of the sheet.

However, in the image forming apparatus described above, because the guide member is disposed such that the front edge of the sheet abuts against the guide member, it is necessary to form the conveying path on an upstream side of the resist roller pair into a curved path. As a result, there is a problem that a length of the conveying path becomes long and thus the size of the image forming apparatus becomes large.

SUMMARY

In accordance with an embodiment of the present disclosure, an image forming apparatus includes a main conveying path, a conveying roller pair, a joining section, an upper sheet feeding part, a lower sheet feeding part, an upper conveying path, a lower conveying path, a conveying guide and a sheet member. Along the main conveying path, a sheet is conveyed upward to an image forming part. The conveying roller pair is provided on the main conveying path. The conveying roller pair is configured to deflect the sheet by stopping its rotation such that a front edge of the sheet abuts against the conveying roller pair to correct a skew of the sheet and then to convey the sheet to the image forming part by stating its rotation at a predetermined timing. The joining section is provided on an upstream side from the conveying roller pair in a sheet conveying direction. The upper sheet feeding part is configured to feed the sheet. The lower sheet feeding part is provided under the upper sheet feeding part and configured to feed the sheet. Along the upper conveying path, the sheet fed from the upper sheet feeding part is conveyed. The upper conveying path is configured to join the main conveying path at the joining section. Along the lower conveying path, the sheet fed from the lower sheet feeding part is conveyed. The lower conveying path is configured to join the main conveying path at the joining section. The conveying guide is provided in the joining section and configured to guide the sheet to the conveying roller pair along the main conveying path. The sheet member is provided in the joining section. The sheet member is configured to form the lower conveying path with the conveying guide and to guide the sheet from the upper conveying path toward the main conveying path. The conveying guide has a convex guide part and planar guide parts. The convex guide part is provided at a center portion in a sheet width direction orthogonal to the conveying direction and projects toward the sheet member. The planar guide parts are provided on both sides in the width direction of the convex guide part. A first gap formed between the convex guide part and the sheet member is narrower than a second gap formed between each of the planar guide parts and the sheet member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
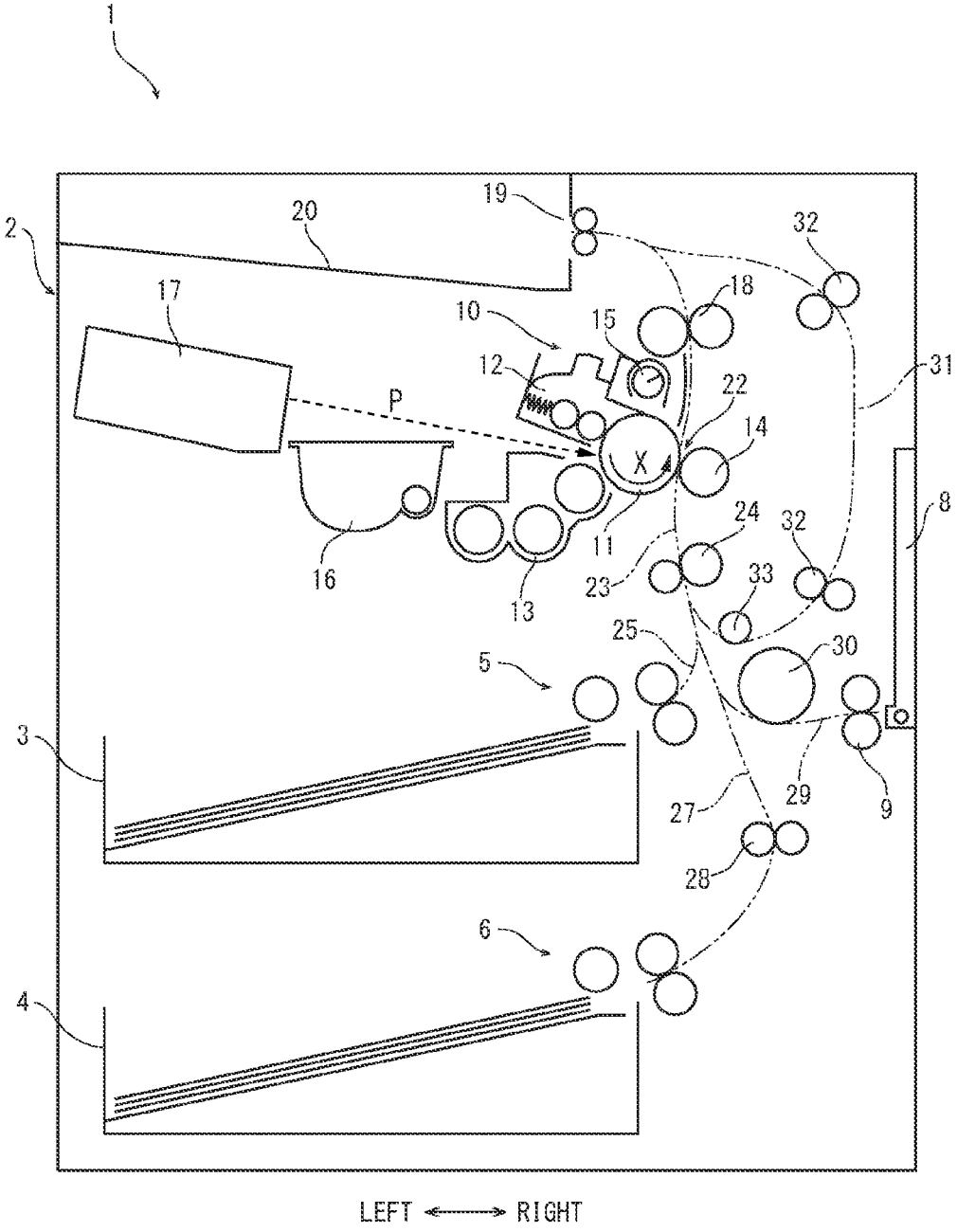
FIG. 1 is a sectional view schematically showing an internal structure of a printer according to one embodiment of the present disclosure.

First, with reference to FIG. 1, an entire structure of a printer 1 as an image forming apparatus will be described. FIG. 1 is a schematic diagram schematically showing an inside structure of the printer according to an embodiment of the present disclosure. In the following description, a front side of the sheet plane of FIG. 1 shows a front side of the printer 1 and left and right directions are based on a direction viewed from the front side of the printer 1.

The printer 1 has a rectangular parallelepiped shaped housing 2 with a hollow space. In a lower part of the inside of the housing 2, an upper sheet feeding cartridge 3 and a lower sheet feeding cartridge 4 in which sheets are stored respectively are arranged in a vertical direction and detachably attached. On an upper right side of each of the upper sheet feeding cartridges 3 and the lower sheet feeding cartridge 4, an upper sheet feeding part 5 and a lower sheet feeding part 6 which respectively feed the sheet from the upper sheet feeding cartridge 3 and the lower sheet feeding cartridge 4 are respectively provided. On a right side of the upper sheet feeding part 5, a manual feeding tray 8 is turnably provided. Inside of the manual feeding tray 8, a feeding roller pair 9 for manual feeding is provided.

Above the upper sheet feeding cartridge 3, an image forming part 10 is provided. The image forming part 10 is provided with a photosensitive drum 11. Around the photosensitive drum 11, a charger 12, a development device 13, a transferring roller 14 and a cleaning device 15 are arranged along a rotation direction (refer to an arrow X in FIG. 1) of the photosensitive drum 11. The development device 13 is connected to a toner container 16. On a left side of the image forming part 10, an exposure device 18 containing a laser scanning unit (LSU) is provided.

Above the image forming part 10, a fixing device 18 is provided and, on a left side of the fixing device 18, a sheet ejecting part 19 is provided. The sheet ejecting part 19 faces an ejected sheet tray 20 formed on an upper surface of the housing 2.

Inside of the housing 2, a main sheet conveying path 23 is formed vertically extending toward the sheet ejecting part 19 through a transferring nip 22 formed between the photosensitive drum 11 and the transferring roller 14 and the fixing device 18. On an upstream side from the transferring nip in the main sheet feeding path 23, a resist roller pair 24 (conveying roller pair) is provided.

On the upstream side from the resist roller pair 24 in the main sheet feeding path 23, a joining section S1 at which an upper sheet conveying path 25 and a lower sheet feeding path 27 are joined is provided. The upper sheet feeding path 25 is formed so as to curve in the right upper direction toward the joining section S1 from the upper sheet feeding part 5. The lower sheet feeding path 27 is formed so as to curve in the right upper direction from the lower sheet feeding part 6 and then to extend straightly in the left oblique direction toward the joining section S1. The lower sheet feeding path 27 is provided with an intermediate roller pair 28. To the lower sheet feeding path 27, a manual feeding path 29 extending from the manual bypass tray 8 is joined at a downstream side portion from the intermediate roller pair 28. The manual feeding path 29 is provided with a feeding roller 30. In addition, the main sheet feeding path 23 is branched into a duplex printing path 31 at the downstream side from the fixing device 18. The duplex printing path 31 is joined to the main sheet feeding path 23 at the joining section S1. Along the duplex printing path 31, a roller pair 32 and a roller 33 are provided.

A part of an outside guide surface of the duplex printing path 31 is formed on a conveying cover unit (not shown) rotatably provided on the right surface of the housing 2. A part of an inside guide surface of the duplex printing path 31 is formed on a transferring conveying unit (not shown) provided rotatably inside the conveying cover unit.

Next, the operation of forming an image by the printer 1 having such a configuration will be described. After a surface of the photosensitive drum 11 is charged by the charger 12, the exposure device 17 exposes the surface of the photosensitive drum 11 with a laser light (refer to an arrow p in FIG. 1) to form an electrostatic latent image on the surface of the photosensitive drum 11. The electrostatic latent image is then developed into a toner image by the developing device 13. The toner remained on the photosensitive drum 11 are removed by the cleaning device 15.

On the other hand, in a case in which the sheet is fed from the upper sheet feeding cartridge 3 or the lower sheet feeding cartridge 4, the sheet is fed from the selected sheet feeding cartridge by the corresponding sheet feeding part. The sheet fed (first fed) from the upper sheet feeding cartridge 3 by the upper sheet feeding part 5 is conveyed through the upper sheet feeding path 25 into the main conveying path 23 at the joining section S1. The sheet fed (second fed) from the lower sheet feeding cartridge 4 by the lower sheet feeding part 6 is guided by the intermediate roller pair 28 and conveyed into the main conveying path 23 at the joining section S1. The sheet fed from the manual tray 8 is conveyed through the manual feeding path 29 by the manual feeding roller pair 9, guided by the feeding roller 30 and then joined to the lower sheet feeding path 27.

When the sheet fed into the main sheet feeding path 23 abuts against the resist roller pair 24, the rotation of the resist roller pair 24 is stopped. Then, the sheet is deflected to collect the skew of the sheet. Then, the rotation of the resist roller pair 24 is started in a suitable timing with the above-mentioned image forming operation to convey the sheet to the transferring nip 22. At the transferring nip 22, the toner image on the photosensitive drum 11 is transferred onto the sheet. The sheet with the transferred toner image is conveyed to a downstream side along the main sheet conveying path 23 to enter the fixing device 18 and then, the toner image is fixed on the sheet in the fixing device 18. The sheet with the fixed toner image is ejected from the sheet ejecting device 19 onto the ejected sheet tray 20.

In a case of duplex printing, the sheet passed through the fixing device 18 is switched back at the sheet ejecting part 19 to be conveyed into the duplex printing path 31. During conveying through the duplex printing path 31, the sheet is reversed. The reversed sheet is conveyed by the roller pair 32 into the main sheet feeding path 23. Then, a toner image in transferred onto a back surface of the sheet at the transferring nip 22 and then fixed on the sheet by the fixing device 18. The sheet with the fixed toner image is ejected from the sheet ejecting part 19 onto the ejected sheet tray 6.

Figure 2:
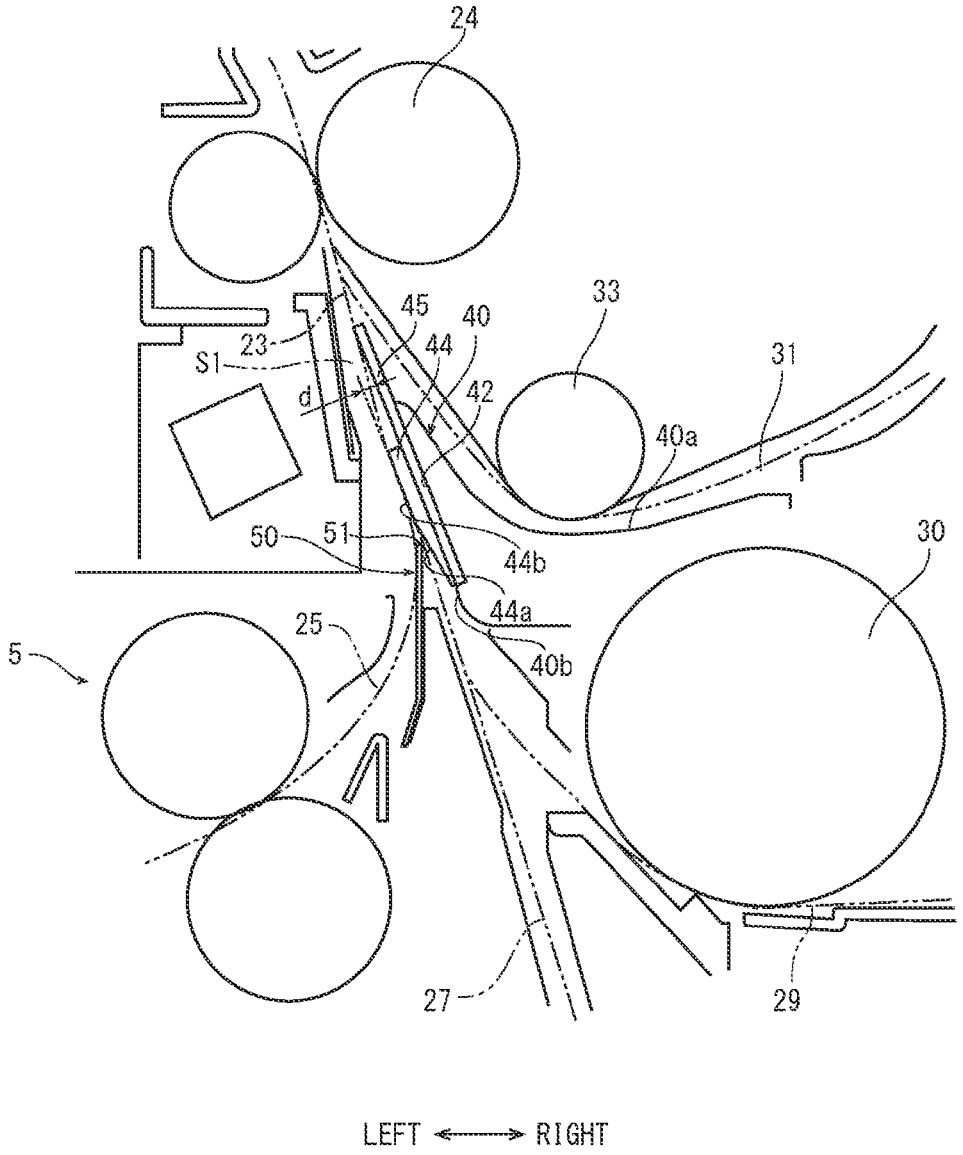
FIG. 2 is a view showing a main conveying path on an upstream side from a transfer nip, in the printer according to one embodiment of the present disclosure.

Next, the joining section S1 in the main conveying path 23 will be described with reference to FIGS. 2 through 4. FIG. 2 is a schematic view showing the joining section S1 in the main conveying path 23, FIG. 3 is a perspective view showing the conveying guide and FIG. 4 is a perspective view showing the conveying guide and a sheet member.

As shown in FIG. 2, in the joining section S1, a conveying guide 40 is provided along a sheet width direction. As shown in FIG. 3, an upper surface 40*a* of the conveying guide 40 forms a part of an inside guide surface of the duplex printing path 31. A left surface 40*b* of the conveying guide 40 forms one guide surfaces of the upper conveying path 25 and the lower conveying path 27.

Figure 3:
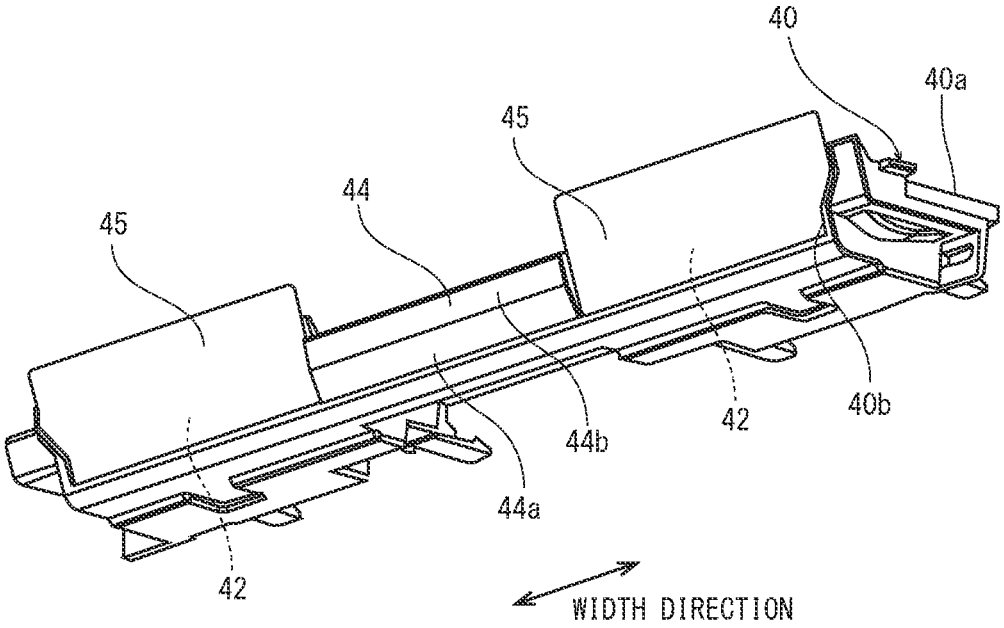
FIG. 3 is a perspective view showing a guide member, in the printer according to one embodiment of the present disclosure.
Figure 4:
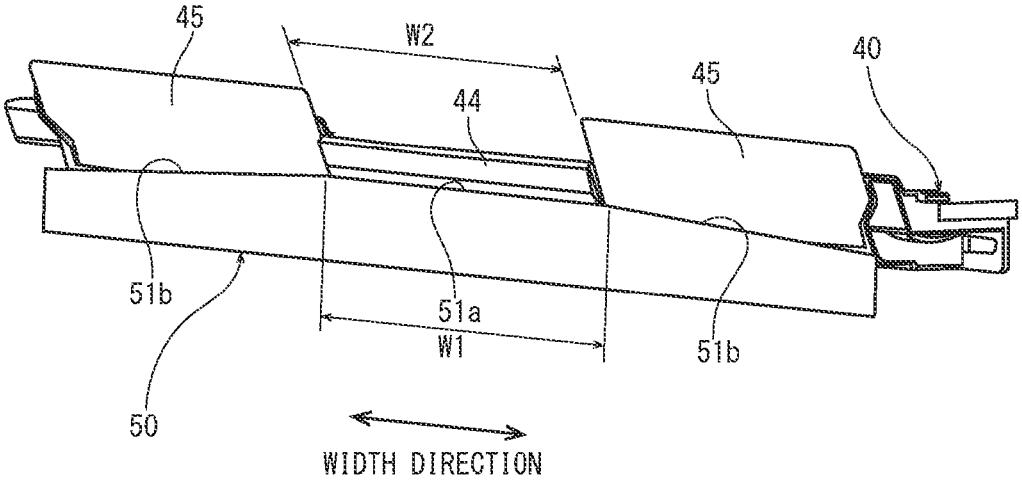
FIG. 4 is a perspective view showing the guide member and a sheet member, in the printer according to one embodiment of the present disclosure.

As shown also in FIG. 3, on the left surface 40*b* of the conveying guide 40, planar guide parts 42 are formed on both side end portions in the sheet width direction and a convex guide part 44 is formed between the planar guide parts 42. The planar guide parts 42 are inclined obliquely in the upper left direction. The convex guide part 44 projects into the upper conveying path 25 and the lower conveying path 27 over the planar guide parts 42. A width in the sheet width direction of the planar guide part 42 is about ⅓ of a width of the conveying guide 40 and a width of the convex guide part 44 is also about ⅓ of the width of the conveying guide 40.

A film member 45 is adhered on each of the planar guide parts 42. Each film member 45 has a horizontally long rectangular shape and projects on the downstream side over the downstream edge of the planar guide parts 42 in the sheet conveying direction. A PET film, for example, may be used for the film member 45.

The convex guide part 44 projects out so as to press the sheet being conveyed under tension between the intermediate roller pair 28 and the resist roller pair 24 into the lower conveying path 27. The convex guide part 44 has an inclined surface 44*a* inclined inward toward the lower conveying path 27 from the upstream side to the downstream side in the sheet conveying direction and a flat surface 44*b* extending in the downstream direction in parallel with the planar guide parts 42 from the downstream end of the inclined surface 44*a*. A gap d between the flat surface 44*b* and the planar guide parts 42 is 2 mm, for example.

As illustrated in FIGS. 2 and 4, a sheet member 50 is provided in the joining section S1 so as to face the left surface 40*b* of the conveying guide 40.

As shown in FIG. 4, the sheet member 50 has a convex shape whose top is located on a center portion in the width direction. That is, the sheet member 50 has a trapezoidal shaped front edge 51 on the downstream side in the sheet conveying direction. The front edge 51 has a center portion 51*a* (front center edge) facing the convex guide part 44 of the conveying guide 40 and side end portions 51*b* (front outer edges) facing respectively the planar guide parts 42. The side end portions 51*b* incline downward (in the upstream side direction in the sheet conveying direction) from the center portion 51*a* toward the outside directions in the width direction. Still further, a width W1 of the center portion 51*a* is longer than a width W2 of the convex guide part 44. A PET film of 0.2 mm thick, for example, may be used as a material of the sheet member 50.

As shown in FIG. 2, the sheet member 50 is provided such that a gap with the left surface 40*b* of the conveying guide 40 is gradually narrowed from the upstream side to the downstream side in the sheet conveying direction. In addition, a first gap between the sheet member 50 and the convex guide part 44 is narrower than a second gap between the sheet member 50 and the planar guide parts 42. The center portion 51*a* of the front edge 51 of the sheet member 50 faces an upper end portion of the inclined surface 44*a* of the convex guide part 44. An angle between the sheet member 50 and the inclined surface 44*a* is an acute angle. Thereby, the upper conveying path 25 is formed so as to be smoothly curved into the joining section S1 from a left surface (surface on a side of the upper conveying path 25) of the sheet member 50 through the inclined surface 44*a* and the flat surface 44*b* of the convex guide part 44. The lower conveying path 25 is formed so that a gap of the lower conveying path 27 becomes narrower toward the joining section S1. A gap between the center portion 51*a* of the front edge 51 of the sheet member 50 and the inclined surface 44*a* is 1 mm, for example. Still further, a gap between the side end portions 51*b* of the front edge 51 and the planar guide parts 42 is 1.9 mm, for example, and the gap becomes wider toward the outside directions in the width direction.

In the printer 1 having a configuration as described above, the sheet fed by the upper sheet feed part 5 from the upper sheet feed cartridge 3 into the upper conveying path 25 is conveyed into the main conveying path 23 at the joining section S1 along the sheet member 50 and the conveying guide 40 and is guided to the resist roller pair 24. Then, after correcting a skew by the resist roller pair 24, the sheet is conveyed to the transfer nip 22 by synchronizing with transfer timing of the toner image.

A sheet fed by the lower sheet feed part 6 from the lower sheet feed cartridge 4 to the lower conveying path 27 is guided by the intermediate roller pair 28 and conveyed into the main conveying path 23 through the gap between the conveying guide 40 and the sheet member 50 at the joining section S1. Here, because the lower conveying path 27 is formed such that the gap between the conveying guide 40 and the sheet member 50 becomes narrower toward the joining section S1 as described above, the sheet can be conveyed stably to the main conveying path 23. In a case in which the sheet is a thin sheet, the sheet does not deflect and is somewhat tensioned between the resist roller pair 24 and the intermediate roller pair 28 when the front edge of the sheet abuts against the resist roller pair 24 to deflect the sheet as described above. However, when the sheet passes through the gap between the conveying guide 40 and the sheet member 50, the both surface of the sheet is pressed by the convex guide part 44 of the conveying guide 40 and the center portion 51*a* of the front edge 51 of the sheet member 50 so that the sheet twisted at the sheet deflecting is stretched in the sheet width direction by the convex guide part 44. Especially, since the first gap between the sheet member 50 and the convex guide part 44 is narrower than the second gap between the sheet member 50 and the planar guide parts 42, the twist of the sheet can be stretched uniformly from the center to the side ends in the width direction. The sheet is then conveyed along the main conveying path 23 with the twist reduced.

As described above, according to the present disclosure, if a thin sheet is conveyed vertically from the lower conveying path 27 along the main conveying path 23, since the sheet twisted at the sheet deflecting is stretched in the sheet width direction by the convex guide part 44 when conveyed through the gap between the convex guide part 44 of the conveying guide 40 and the sheet member 50. Accordingly, it becomes possible to form an image on a wrinkleless thin sheet.

Still further, the convex guide part 44 of the conveying guide 40 is formed to project into the lower conveying path 27 over the path through which the sheet is conveyed under tension between the intermediate roller pair 28 and the registration roller pair 24. In other words, the convex guide part 44 presses the sheet, being conveyed under tension between the intermediate roller pair 28 and the resist roller pair 24, toward the sheet member 50. Thereby, when the front edge of the thin sheet abuts against the resist roller pair 24 to deflect the sheet, if the thin sheet does not deflect suitably and is somewhat tensioned between the resist roller pair 24 and the intermediate roller pair 28, the deflection caused by the collection of the sheet skew is stretched in the sheet width direction by the convex guide part 44. Accordingly, because the sheet is pulled up by the resist roller pair 24 in a condition in which the sheet is stretched in the sheet width direction, a wrinkle is hardly generated.

Still further, because the convex guide part 44 is formed such that a length thereof in the conveying direction is shorter than that of the planar guide part 42 on the both sides of the convex guide part 44, it is possible to reduce a conveying load of the sheet and to convey the sheet stably.

Still more, because the center portion 51*a* of the front edge 51 of the sheet member 50 is formed to be wider than that of the convex guide part 44, it is possible to stably assure the gap between the convex guide part 44 and the center portion 51*a* of the front edge 51 and to stretch the twist of the sheet uniformly.

Because the front edge 51 of the sheet member 50 is formed into the trapezoidal shape, the sheet does not overlap with the sheet member 50 on the both sides in the width direction. Therefore, when a sheet jams in the upper conveying path 25 and then the conveying cover unit is turned to separate the conveying guide 40 from the sheet member 50, it is possible to grasp the both side end portions of the sheet inside the sheet member 50 through a space above the both side end portions 51*b* of the front edge 51 of the sheet member 50. Therefore, this arrangement makes it possible to readily handle the sheet jammed in the upper conveying path 25. It is noted that the shape of the front edge 51 of the sheet member 50 is not limited to be the trapezoidal shape, and a rectangular convex part may be formed at the center part of the front edge 51 so as to face the convex guide part 44, for example.

It is also noted that in the present embodiment, the gap d between the flat surface 44*b* of the convex guide part 44 and the planar guide part 42, the width of the convex guide part 44, the relative positional relationship between the sheet member 50 and the conveying guide 40, and others are defined corresponding to the shape of the main conveying path 23 and other conveying paths.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a main conveying path along which a sheet is conveyed upward to an image forming part;

a conveying roller pair provided on the main conveying path, the conveying roller pair configured to deflect the sheet by stopping its rotation such that a front edge of the sheet abuts against the conveying roller pair to correct a skew of the sheet and then to convey the sheet to the image forming part by stating its rotation at a predetermined timing;

a joining section provided on an upstream side from the conveying roller pair in a sheet conveying direction;

an upper sheet feeding part configured to feed the sheet;

a lower sheet feeding part provided under the upper sheet feeding part and configured to feed the sheet;

an upper conveying path along which the sheet fed from the upper sheet feeding part is conveyed and configured to join the main conveying path at the joining section;

a lower conveying path along which the sheet fed from the lower sheet feeding part is conveyed and configured to join the main conveying path at the joining section;

a conveying guide provided in the joining section and configured to guide the sheet to the conveying roller pair along the main conveying path; and a sheet member provided in the joining section, the sheet member being configured to form the lower conveying path with the conveying guide and to guide the sheet from the upper conveying path toward the main conveying path:

wherein the conveying guide includes a convex guide part provided at a center portion in a sheet width direction orthogonal to the conveying direction and projecting toward the sheet member, and planar guide parts provided on both sides in the width direction of the convex guide part, and wherein a first gap formed between the convex guide part and the sheet member is narrower than a second gap formed between each of the planar guide parts and the sheet member.

2. The image forming apparatus according to claim 1, further comprising an intermediate roller pair provided on the lower sheet conveying path, wherein the convex guide part projects toward the sheet member such that the sheet being conveyed with tension between the intermediate roller pair and the conveying roller pair along the main conveying path and the lower sheet conveying path is pressed toward the sheet member.

3. The image forming apparatus according to claim 1, wherein the convex guide part is formed to have a length in the sheet conveying direction shorter than that of the planar guide parts and a space is formed between the planar guide parts in the sheet width direction on the downstream side of the convex guide part in the sheet conveying direction.

4. The image forming apparatus according to claim 1, wherein the sheet member has a front center edge facing the convex guide part of the conveying guide and the front center edge is formed with a width in the sheet width direction wider than that of the convex guide part.

5. The image forming apparatus according to claim 1, wherein a width of the convex guide part in the sheet width direction is about ⅓ of a width of the conveying guide.

6. The image forming apparatus according to claim 1, wherein the first gap is formed to be narrower on the downstream side than the upstream side in the conveying direction.

7. The image forming apparatus according to claim 1, wherein the convex guide part of the conveying guide includes an inclined surface inclined toward the sheet member in the downstream direction in the conveying direction, and a flat surface extending in the downstream direction in the conveying direction from a downstream edge of the inclined surface in parallel with the planar guide parts, and wherein a front edge 51 of the sheet member faces the inclined surface.

8. The image forming apparatus according to claim 1, wherein the second gap is formed to be narrower on the downstream side than the upstream side in the conveying direction, the sheet member has front outer edges configured to face the planar guide parts and the front outer edges incline from the center to the both ends in the sheet width direction toward the upstream side in the conveying direction.

9. The image forming apparatus according to claim 1, wherein a film member is adhered on each of the planar guide parts of the conveying guide.

10. The image forming apparatus according to claim 1, wherein the conveying guide includes an upper guide surface of a duplex printing path which joins the main conveying path at the joining section from a side opposite to the upper conveying path.

* * * * *